US005728515A

United States Patent [19]

Irving et al.

[11] Patent Number: 5,728,515

[45] Date of Patent: Mar. 17, 1998

[54] IODIDE CONTAINING HIGH BROMIDE TABULAR GRAIN EMULSIONS EXHIBITING IMPROVED PHOTOEFFICIENCY

[75] Inventors: Mark Edward Irving; JoAnn Demicco Hanna, both of Rochester; Sharon Ruth Lunt, Webster, all of N.Y.

[73] Assignee: Eastman Kodak Company, Rochester, N.Y.

[21] Appl. No.: 639,449

[22] Filed: Apr. 29, 1996

[51] Int. Cl.[6] ..... G03C 1/035

[52] U.S. Cl. ..... 430/567

[58] Field of Search ..... 430/567, 569

[56] References Cited

U.S. PATENT DOCUMENTS

| | | | |
|---|---|---|---|
| 4,433,048 | 2/1984 | Solberg et al. | 430/434 |
| 4,434,226 | 2/1984 | Wilgus et al. | 430/567 |
| 5,314,793 | 5/1994 | Chang et al. | 430/506 |
| 5,360,703 | 11/1994 | Chang et al. | 430/567 |
| 5,470,698 | 11/1995 | Wen | 430/567 |
| 5,641,618 | 6/1997 | Wen et al. | 430/567 |
| 5,650,266 | 7/1997 | Taguchi et al. | 430/567 |
| 5,667,954 | 9/1997 | Irving et al. | 430/567 |

*Primary Examiner*—Mark F. Huff

*Attorney, Agent, or Firm*—Carl O. Thomas

[57] ABSTRACT

A photographically useful high bromide tabular grain silver halide emulsion is disclosed in which iodide is incorporated in a tabular grain central region to lower contrast and in a peripheral region zone to increase photoefficiency. A further increase in photoefficiency is provided by an annular spacer region interposed between the central region and peripheral region zone having a lower iodide content than either.

16 Claims, No Drawings

IODIDE CONTAINING HIGH BROMIDE TABULAR GRAIN EMULSIONS EXHIBITING IMPROVED PHOTOEFFICIENCY

FIELD OF THE INVENTION

The invention is directed to photographically useful silver halide emulsions.

DEFINITION OF TERMS

In referring to silver halide emulsions, grains or grain regions containing two or more halides, the halides are named in order of ascending concentrations.

The term "high bromide" in referring to silver halide grains and emulsions is employed to indicate greater than 50 mole percent bromide, based on total silver, forming the grains and emulsions, respectively.

The term "tabular grain" is defined as a grain having an aspect ratio of at least 2.

The term "tabular Grain emulsion" is defined as an emulsion in which greater than 50 percent of total grain projected area is accounted for by tabular grains.

The term "total silver" is used to indicate all of the silver forming an entire grain or an entire grain population. Other references to "silver" refer to the silver forming the relevant portion of the grain structure—i.e., the region, portion, zone or specific location under discussion.

The symbol "μm" is used to represent micrometer(s).

The symbol "M %" is used to designate mole percent.

*Research Disclosure* is published by Kenneth Mason Publications, Ltd., Dudley House, 12 North St., Emsworth, Hampshire P010 7DQ, England.

BACKGROUND

Latent image forming silver halide emulsions employed in photography contain silver halide grains of a rock salt face centered cubic crystal lattice structure formed by silver bromide, silver chloride or mixtures thereof. Silver iodide does not form a rock salt face centered cubic crystal lattice structure, but iodide ions can be accommodated in the crystal lattice structures of silver chloride and/or bromide in minor amounts, up to a saturation level ranging from about 13 to 40 mole percent, based on silver, for silver chloride and silver bromide, respectively.

In a typical double-jet precipitation iodide ions are run into a reaction vessel along with silver ions and chloride and/or bromide ions to integrate the iodide ions into the face centered cubic crystal lattice structure of the latent image forming grains. The commonly used term "run iodide" refers to iodide ion introduction and incorporation at concentration levels that can be accommodated by the face centered cubic crystal lattice structure. That is, iodide ion concentrations below supersaturation are maintained.

The incorporation of minor amounts of iodide ion in the crystal lattice structure of latent image forming silver halide grains is well known to be a useful technique for modifying photographic performance. The incorporation of iodide ions reduces the rate of grain development and increases photoefficiency (the amount of light required to produce a developable latent image). The highest attainable levels of photoefficiency are realized using high bromide silver halide grains containing a minor amount of iodide. The overwhelming majority of camera speed photographic films employ silver iodobromide emulsions.

Wilgus et al U.S. Pat. No. 4,434,226 advanced the state-of-the art by preparing silver iodobromide tabular grain emulsions in which tabular grains having a thickness of <0.3 μm and average aspect ratio of >8 account for >50 percent of total grain projected area. This was accomplished by withholding iodide from the reaction vessel prior to silver ion addition and undertaking run iodide addition during subsequent double-jet precipitation. The silver iodobromide tabular grain emulsions of Wilgus et al exhibited improved speed-granularity relationships as compared to the emulsions previously available to the art. An improved speed-granularity relationship can be used to increase speed without increasing (or without correspondingly increasing) granularity or to reduce granularity without reducing (or without correspondingly reducing) speed. In comparing emulsions of similar levels of photoefficiency, a speed difference of 30 relative log units (i.e., 0.30 log E, where E represents exposure in lux-seconds) results in a granularity difference of 7 grain units.

Solberg et al U.S. Pat. No. 4,433,048 demonstrated that speed could be further increased without increasing granularity in silver iodobromide tabular grains by a controlled, non-uniform distribution of iodide within the tabular grains. Specifically, Solberg et al demonstrated that a lower iodide concentration in a central region than in a laterally surrounding peripheral region increases speed without increasing granularity as compared to an otherwise similar tabular grain emulsion having an essentially uniform distribution of iodide within the tabular grains.

Solberg et al discloses two alternative techniques for forming the higher iodide peripheral region of the tabular grains. In a run iodide precipitation the concentration of iodide is progressively increased as the silver and halide salts are run into the reaction vessel during tabular grain precipitation. In a second approach, commonly referred to as a "dump iodide" approach, an increased concentration of iodide is abruptly introduced during formation of the annular region. Although both approaches improve photoefficiency, the latter, dump iodide approach produces larger speed increases and has become the approach most commonly relied upon to realize the highest attainable levels of photoefficiency.

Although difficult to characterize, it is generally accepted that the abrupt addition of iodide creates disorder in the face centered cubic crystal lattice structure of the peripheral region. Chang et al U.S. Pat. No. 5,314,793 and Wen U.S. Pat. No. 5,470,698 demonstrate that the presence of grain structures resulting from dump iodide introduction in high bromide tabular grains can be identified by a shifted spectrum of stimulated fluorescent emission. Specifically, when high bromide tabular grains containing abruptly increased iodide concentrations are exposed to 325 nm electromagnetic radiation at 6° K., the intensity of stimulated fluorescent emission at 575 nm is increased in relation to the maximum intensity of stimulated fluorescent emission in the wavelength range of from 490 to 560 nm.

Although larger increases in photoefficiency are realized by dump iodide addition than by run iodide addition, the two approaches are not incompatible and, in fact, offer significant advantages when employed in combination. High bromide tabular grain emulsions that incorporate both run iodide and dump iodide are commonly referred to as "run-dump" emulsions. Typically, these emulsions are prepared by running iodide in with the remaining halide ions at a concentration that can be accommodated within the silver bromide face centered cubic crystal lattice structure with the iodide run being interrupted by an iodide dump to recreate an annular band relied upon for the maximum attainable photoefficiency. The run iodide can contribute to varied photographic performance characteristics, but is most commonly relied upon to lower the contrast of the tabular grain emulsion. Both Chang et al and Wen, cited above, demonstrate run-dump tabular grain emulsion precipitations in their examples.

SUMMARY OF THE INVENTION

In one aspect, this invention is directed to a radiation-sensitive emulsion comprised of a dispersing medium and silver halide grains including tabular grains accounting for greater than 50 percent of total grain projected area, having {111} major faces, and containing greater than 50 mole percent bromide and at least 0.5 mole percent iodide, based on total silver, wherein the tabular grains include tabular grains having a controlled, non-uniform iodide distribution providing, when the emulsion is exposed to 325 nm electromagnetic radiation at 6° K., a stimulated fluorescent emission at 575 nm that is at least 5 percent of the maximum intensity of concurrently stimulated fluorescent emission in the wavelength range of from 490 to 560 nm, the controlled, non-uniform iodide distribution tabular grains being comprised of (a) a central region accounting for from 5 to 85 percent of total silver and containing an iodide concentration of at least 0.5 mole percent, based on silver, (b) an annular spacer region extending laterally outward from the central region, accounting for at least 2 percent of total silver, and containing an iodide concentration that is less than half the iodide concentration of the central region, and (c) a peripheral region comprised of a zone extending outwardly from and having a higher iodide concentration than the annular spacer region, iodide within the zone providing the stimulated fluorescent emission at 575 nm.

It has been discovered quite unexpectedly that separating the iodide containing central region and peripheral region zone with an annular spacer region of a lower iodide concentration provides a further increase in photographic speed. Prior to this invention it was thought that run iodide addition and dump iodide addition were entirely compatible, since the most desirable overall levels of photographic performance had been obtained employing a combination of both types of iodide incorporation. This invention demonstrates for the first time that reducing the amount of iodide at the edges of the tabular grains at the time dump iodide addition occurs results in higher levels of photoefficiency.

Thus, the invention makes possible high bromide tabular grain emulsions having higher levels of photoefficiency (i.e., photographic speed) than have heretofore been realized by run-dump iodide incorporations.

DESCRIPTION OF PREFERRED EMBODIMENTS

This invention is an improvement on conventional radiation-sensitive emulsions comprised of a dispersing medium and silver halide grains including tabular grains accounting for greater than 50 percent of total grain projected area, having {111} major faces, and containing greater than 50 mole percent bromide and at least 0.5 mole percent iodide, based on total silver.

The performance of these conventional emulsions is improved when the tabular grains include tabular grains having at least three regions. These three regions can be visualized by reference to the following schematic diagrams:

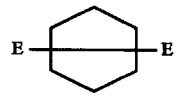

Diagram A

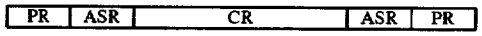

PR = peripheral region
ASR = annular spacer region
CR = central

Diagram B

Diagram A shows a hexagonal {111} major face of a typical controlled, non-uniform iodide tabular grain satisfying the novel structure requirements of this invention while Diagram B shows, on an increased scale, a cross-sectional view along section line E—E of the three regions.

The central region contains, on average, from 5 (preferably at least 10 and typically at least 50) to 85 percent of the total silver forming the tabular grain. The central region also contains an iodide concentration of least 0.5 (preferably 1.0) mole percent, based on silver (the silver forming the central region). The iodide level in the central region is throughout below the saturation level of the face centered cubic crystal lattice structure of the grain. While the iodide saturation level of a silver bromide crystal lattice structure is about 40 mole percent, it is preferred to maintain both the maximum and average iodide level in the central region below 35 mole percent, most preferably below 20 mole percent, and optimally below 15 mole percent, based on silver.

At the lower average levels of iodide in the central region it is appreciated that there is a greater freedom to have higher maximum iodide concentrations present without exceeding iodide saturation levels. Thus, it is apparent that the iodide in the central region can be either uniformly or non-uniformly distributed.

For example, it is possible to form the central region by uniform run iodide incorporation, as taught by Wilgus et al, cited above, or graded run iodide incorporation as taught by Solberg et al, cited above, but with the concentration of iodide either increasing or decreasing in a direction from the center of the grain (the nucleation site) to the lateral edge of the central region. Additionally, it is believed that first increasing and then decreasing run iodide concentrations during growth of the central region may produce optimum performance for at least some photographic applications.

In another variation on the structure of the central region, some portion of the central region can be grown before iodide is introduced. Wilgus et al, cited above, teaches minimizing the presence of iodide during tabular grain nucleation to avoid grain thickening. This delay in iodide introduction can be so slight as to be non-detectable in the final grain structure (that is, the iodide distribution can appear uniform), but it is possible to delay iodide introduction during formation of the central region so that well formed tabular grains lacking iodide are created before run iodide addition is begun. To avoid diminishing the advantages provided by a run iodide containing grain region, it is preferred that the iodide-free portion account for less than 40 percent of the central region. In most instances any iodide free portion of the central region is less than 10 percent and, most commonly, less than 5 percent of the central region.

The annular spacer region, ASR, is grown on the peripheral edge of the central region to minimize contact between the iodide containing portion of the central region and the peripheral region, PR. The annular spacer region is contemplated to contain an iodide concentration less half that of the central region. Ideally the annular spacer region is formed without adding iodide. In this instance, any iodide that can be found in the annular spacer region has migrated into this region from either the central region or the peripheral region. Generally the largest increases in photoefficiency are realized by minimizing iodide in the annular spacer region.

It is contemplated that the annular spacer region, on average, account for at least 2 (preferably 4) percent of the total silver forming the controlled iodide distribution tabular grains. The maximum amount of silver contained in the annular spacer region is limited only by the minimum amounts of silver required to form the remaining regions of the tabular grains. Up to about 85 percent of total silver forming the tabular grains can be located in the annular spacer region without unduly restricting formation of the remaining grain regions. An annular spacer region containing greater than 50 percent of total silver is demonstrated in the Examples below. To obtain the full advantages of run iodide in the central region, it is preferred to limit the annular spacer region to less than 25 percent of total silver.

In a simple form the peripheral region consists of an iodide containing Zone formed entirely by dump iodide addition. However, it is a preferred conventional practice to follow dump iodide addition, creating the first formed zone of the peripheral region zone, with formation of a second zone of the peripheral region without dump iodide addition and, in most instances, without any further iodide addition.

The second zone can, in one extreme form, provide up to 50 percent of total grain projected area. That is, it can, on average, contain up to 50 percent of total silver forming the tabular grains. In grain structures in which the second zone accounts for a large percentage of total silver (e.g., >25 percent of total silver), it is advantageous to form the second zone under conditions that are favorable for tabular grain growth (i.e., favorable for growth primarily along the edges of the tabular grains being grown). Wen et al, cited above, and the Examples below illustrate extended tabular grain growth after dump iodide addition.

At the opposite extreme, silver halide precipitated after dump iodide addition is not intended to increase the projected area of the tabular grains. Instead its function is limited to providing a low iodide shell that covers the major faces and edges of the tabular grains. This can be visualized by the following diagram:

| PR | ASR | CR | ASR | PR1 |
|---|---|---|---|---|

Diagram C wherein PR1 is the zone of the peripheral region formed by dump iodide addition and the second zone is shown as a uniform shell surrounding each of PR1, ASR and CR. By minimizing iodide at the surface of the grains faster initial development rates are realized that translate into increased speeds at lower density levels (where speed is commonly measured). A common technique for shelling is simply to undertake a silver overrun following final iodide addition. That is, silver alone is added to the reaction vessel, and this silver reacts in the dispersing medium with the halide ion remaining unprecipitated, which includes no iodide ion. Note that the much lower solubility of silver iodide as compared to silver bromide or chloride drives all iodide ion introduced toward immediate precipitation. Since silver halide is precipitated with a stoichiometric excess of halide ion to avoid fog, the excess halide ion remaining after iodide addition is terminated is a halide ion other than iodide, and it is this halide ion that reacts with silver to form the shell.

It is appreciated that all intermediates between the extremes in second zone structure described above are feasible. In practice, it is generally preferred that at least about 10 percent of total silver be present in the second zone. On the other hand, when the second zone is precipitated as a shell, it is typically limited to less than 35 percent of total silver.

As little as 0.5 mole percent iodide, based on total silver, added as dump iodide, has been demonstrated to impart increased levels of photoefficiency. Large amounts of dump iodide are neither required nor desirable. Dump iodide concentrations rarely exceed 5 mole percent, based on total silver. A preferred dump iodide range is from 1 to 3 mole percent, based on total silver.

Highly elevated local concentrations of iodide are believed to be produced by dump iodide addition, but probing techniques have not been successful in verifying expected peak local iodide concentrations. Note, for example, that Solberg et al uses a 0.2 μm spot size in probing for iodide concentrations and the iodide concentrations reported are actually averages of iodide concentrations throughout the thickness of the tabular grains. Although confirmation is lacking, it is believed that local iodide concentrations can be produced by dump iodide addition of up to saturation levels and, in some instances, depending on the emulsion preparation technique employed, a separate high (>90 mole percent) iodide concentration can be identified. The dump iodide zones of the peripheral regions may not be continuous and, in extreme cases, may not be tabular. Edge castellations are reported for dump iodide additions by Solberg et al while microscopic grain examinations often show edge decorations on the tabular grains attributed to dump iodide to be visually observable over a major portion, but not all of the tabular grain edges.

It is these high local iodide concentrations, abruptly introduced, that create crystal lattice disorder, resulting in a distinctive stimulated fluorescent emission, demonstrated by Chang et al U.S. Pat. Nos. 5,314,793 and 5,360,703 and Wen U.S. Pat. No. 5,470,698. Specifically, when high bromide tabular grains produced by dump iodide addition are exposed to 325 nm electromagnetic radiation at 6° K., the intensity of stimulated fluorescent emission at 575 nm is increased in relation to the maximum intensity of stimulated fluorescent emission in the wavelength range of from 490 to 560 nm. Chang et al '793 discloses dump iodide of 1 mole percent, based on total silver to increase stimulated fluorescent emission at 575 nm to at least one third the maximum intensity in the 490 to 560 nm range. Dump iodide concentrations of ≧3.5 mole percent, based on silver, increase the 575 nm stimulated emission to 90 percent or more of the maximum stimulated emission intensity in the 490 to 560 nm range.

In the emulsions of this invention it is contemplated that stimulated fluorescent emission will be at least 5 (preferably at least 15, most preferably at least 35, and optimally at least 50) percent of the maximum intensity concurrently stimulated emission in the 490 to 560 nm range. It is contemplated that the same levels of stimulated fluorescent emission at 575 nm can be obtained when the same levels of iodide are employed as noted by Chang et al and the entire tabular grain population has been prepared in the same precipitation. When emulsions prepared by run iodide addition only are blended with run-dump tabular grain emulsions, both grain populations contribute stimulated fluorescent emission intensity in the 490 to 560 nm range, while only the tabular grains produced by run-dump precipitation contribute significantly to stimulated fluorescent emission at 575 nm. Thus, blending lowers the apparent intensity of stimulated fluorescent emission at 575 nm as a percentage of the 490 to 560 nm range emission, since the stimulated fluorescent emission cannot be assessed on a grain-by-grain basis, but is an aggregate response of the total emulsion sample. So long as the total emulsion 575 nm stimulated fluorescent emission satisfies the percentages stated above, the proportion of the run-dump tabular grains satisfying the requirements of the invention is adequate to produce a significant enhancement in photoefficiency. It is generally preferred that at least 50 percent of tabular grain projected area be accounted for by the run-dump tabular grains having an annular spacer region satisfying the requirements of the invention.

Apart from the grain features described above, the emulsions of the invention can take any convenient conventional form. The tabular grains preferably account for greater than 70 percent, optimally at least 90 percent, and ideally substantially all (≧97%) of total grain projected area. The tabular grains typically have an average thickness of less than 0.3 μm and preferably less than 0.2 μm. The tabular grains in the emulsions of the invention and particularly the non-uniform structured iodide grains of these emulsions preferably have an average aspect ratio of at greater than 5 and, most preferably, greater than 8.

The high bromide tabular grains preferably contain greater than 70 mole percent bromide and optimally greater than 90 mole percent bromide. Silver iodobromide tabular grains are specifically contemplated. Any remaining halide after bromide and iodide concentrations levels, described above, have been satisfied can be chloride. Preferred chloride concentrations can range up to 20 mole percent, based on total silver. Delton U.S. Pat. Nos. 5,372,927 and 5,460,934, here incorporated by reference, disclose performance advantages for tabular grain emulsions containing chloride concentrations in the range of from 0.4 to 20 mole percent, based on total silver.

Tabular grain emulsions satisfying the requirements of the invention by merely interposing the step of precipitating the annular spacer region prior to dump iodide addition. Thus, the emulsion preparation procedures of Solberg et al, Chang et al and Wen, cited above, are here incorporated by reference to disclose procedures that can be readily modified in view of this disclosure to obtain the emulsions of the invention.

The following patents pertaining to high bromide tabular grain emulsions, their sensitization and photographic use, are here incorporated by reference to disclose conventional features of the emulsions These patents:

| | |
|---|---|
| Kofron et al | U.S. Pat. No. 4,439,520; |
| Wilgus et al | U.S. Pat. No. 4,434,226; |
| Solberg et al | U.S. Pat. No. 4,433,048; |
| Maskasky | U.S. Pat. No. 4,435,501; |
| Daubendiek et al | U.S. Pat. No. 4,672,027; |
| Maskasky | U.S. Pat. No. 4,713,320; |
| Daubendiek et al | U.S. Pat. No. 4,914,014; |
| Antoniades et al | U.S. Pat. No. 5,250,403; |
| Tsaur et al | U.S. Pat. No. 5,210,013; |
| Black et al | U.S. Pat. No. 5,334,492; |
| Maskasky | U.S. Pat. No. 5,411,851; |
| Maskasky | U.S. Pat. No. 5,411,853; |
| Maskasky | U.S. Pat. No. 5,418,125; |
| Daubendiek et al | U.S. Pat. No. 5,494,789. |

EXAMPLES

The invention can be better appreciated by reference to the following specific embodiments.

Several series of emulsions have been prepared in which the three building block regions CR, ASR and PR were manipulated. Example 1 compares emulsions with and without the annular spacer region. In Example 2, the concentrated addition of iodide is systematically changed from zero to 3% based on total silver content. In addition, the mode of iodide addition was varied. Example 3 varies the annular spacer region as a percent of total precipitated silver. Example 4 demonstrates the role of the iodide Distribution Factor (or IDF), which is calculated as the average local run iodide concentration in mole percent (M % I) minus the percentage of total silver precipitated prior to initiating run iodide addition (% Ag)—that is, the amount of silver in region N shown below.

All emulsions described in the examples were chemically sensitized with sulfur and gold and spectrally sensitized with the following green dyes:

Dye 1

Anhydro-5-chloro-9-ethyl-5'-phenyl-3'-(3-sulfobutyl)-3-(3-sulfopropyl)oxacarbocyanine hydroxide triethylamine salt and Dye 2

Anhydro-6,6'-dichloro-1,1'-diethyl-3,3'-di(3-sulfopropyl)-5,5'-ditrifluoromethylbenzimidazolocarbocyanine hydroxide sodium salt.

The emulsions were blended with a cyan dye-forming coupler and coated on a photographic film support at a silver coverage of 8.61 mg/dm$^2$. The coatings were exposed through a step wedge to daylight at a color temperature of 5500° K. for 0.01 second, followed by development for 3 minutes 15 seconds using Kodak Flexicolor™ C-41 process (described in British Journal of Photography Annual, 1977, pp. 201–206). The processed samples were evaluated for speed and gamma (γ). Speed is given in relative CR units, where 1 CR unit is equal to 0.01 log E where E represents exposure in lux-seconds. Speed was measured at a toe density of $D_s$, where $D_s$ minus $D_{min}$ equals 20 percent of the slope of a line drawn between $D_s$ and a point D' on the characteristic curve offset from $D_s$ by 0.6 log E. Gamma is the slope of the linear portion of the characteristic curve midway between the maximum and minimum densities.

Example 1

The iodide distribution profiles of the emulsions compared in this example are shown below:

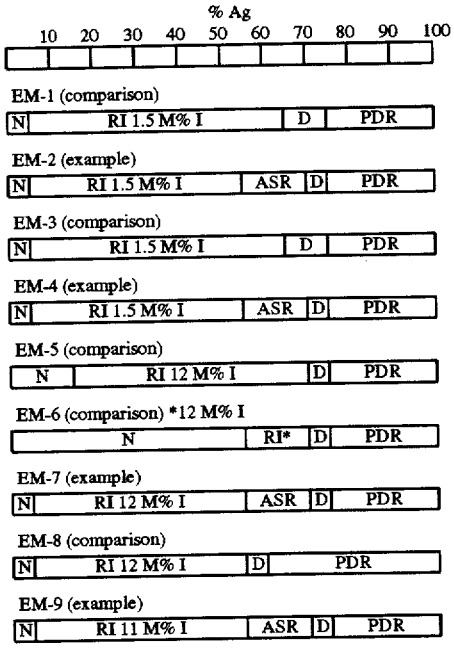

wherein

N=AgBr used in nucleation;

RI=AgIBr (run iodide);

ASR=AgBr annular spacer region;

D=Dump iodide addition;

PDR=Post dump AgBr run

Emulsions EM-1 through EM-4 are silver iodobromide high (>8) aspect ratio tabular grain emulsions prepared using a 1.5M % iodide, based on silver, double-jet run addition and a dump iodide addition employing silver iodide Lippmann emulsion. The comparative emulsions introduced dump iodide immediately after run iodide while the example emulsions interposed between the run and dump iodide additions a silver and bromide ion only double-jet addition.

Emulsion EM-1 Comparative Emulsion

The following solutions were prepared for the precipitation of this emulsion:

| |
|---|
| Solution A-1 |
| 10 gm bone gelatin<br>30 gm sodium bromide<br>1.3 mL antifoamant<br>4946 mL distilled water |
| Solution B-1 |
| 0.39M silver nitrate |
| Solution C-1 |
| 2.0M sodium bromide |
| Solution D-1 |
| 350 mL 0.51M ammonium sulfate |
| Solution E-1 |
| 148 mL 2.5M sodium hydroxide |
| Solution F-1 |
| 92.5 mL 4.0M nitric acid |
| Solution G-1 |
| 140 gm bone gelatin |

-continued

| |
|---|
| 0.45 cc antifoamant<br>1700 mL distilled water |
| Solution H-1 |
| 2.75M silver nitrate |
| Solution I-1 |
| 2.71M sodium bromide<br>0.041M potassium iodide |
| Solution J-1 |
| 2.4M sodium bromide |
| Solution K-1 |
| 0.36 mol silver iodide Lippmann emulsion |

To solution A-1 at 52° C., pH 5.9, and pAg 9.74 were added with vigorous stirring solutions B-1 and C-1 over a period of 3 minutes precipitating 0.1 mole of silver bromide. After a 1 minute hold, solution D-1 and E-1 were added sequentially. After 3 minutes, solution F-1 was added followed by solution G-1. Then solutions B-1 and C-1 were added at a constant flow rate by double-jet addition to yield a total of 0.27 mole of silver bromide. Solutions H-1 and I-1 were added by double-jet addition utilizing accelerated flow for 57 minutes while maintaining the pAg at 9.61 and consuming 68% of the total silver used. The pAg was then adjusted to 10.18 with solution J-1. The emulsion was held for 2 minutes after solution K-1 was added. Solutions H-1 and C-1 were then added to the element over 26 minutes while adjusting the pAg to 8.52. The emulsion was then cooled and desalted. Approximately 12 moles of silver were used to prepare this and subsequent emulsions.

The resultant silver iodobromide high aspect ratio tabular grain emulsion had an average grain equivalent circular diameter (ECD) of 1.23 μm and a mean thickness of 0.116 μm. The bulk iodide level was 4.1M % iodide, based on total silver. Tabular grains accounted for more than 90 percent of the total grain projected area. The specific surface area was measured at 560 $m^2$/mol.

Emulsions EM-2 to EM-4 were prepared to match the average volume, ECD and grain thickness of emulsion EM-1. Measured specific surface areas are noted.

Emulsion EM-2 Example Emulsion

This emulsion example was identical to EM-1, except that a silver bromide annular spacer region was precipitated between the run and dump iodide additions. The following additional solution was prepared for the precipitation of EM-2.

| |
|---|
| Solution L-2 |
| 2.75 M sodium bromide |

The preparation of EM-1 was repeated through the second addition of solutions B-1 and C-1. In the next segment, solutions H-1 and I-1 were added by double-jet addition utilizing accelerated flow for 49 minutes while maintaining the pAg at 9.61 and consuming 53% of the total silver used. Solution L-2 then replaced solution I-1 for the next 7.3 minutes over which time another 16% of the total silver was consumed. The remainder of the precipitation was identical to EM-1 starting with the pAg adjustment to 10.18 with solution J-1.

The resultant silver iodobromide high aspect ratio tabular grain emulsion had a bulk iodide level of 3.8M % iodide, based on total silver. Tabular grains accounted for more than 90 percent of the total grain projected area. The specific surface area was 540 $m^2$/mol.

The photographic results are summarized in Table I.

TABLE I

| Emulsion | ASR % Ag | Relative CR Speed | gamma |
|---|---|---|---|
| EM-1 (comparison) | 0 | 100 | 1.47 |
| EM-2 (example) | 16 | 105 | 1.82 |

The speed and gamma increases of EM-2 over EM-1 are attributed to the presence of the annular spacer region separating the run iodide and dump iodide containing regions of the tabular grains.

Emulsion EM-3 Comparative Emulsion

This emulsion example was identical to EM-1, except that the amount of silver halide precipitated during dump iodide addition was increased.

The preparation of EM-1 was repeated, except solution K-1 was replaced with the following solution.

| Solution K-3 |
|---|
| 0.55 mol silver iodide Lippmann emulsion |

The resultant silver iodobromide high aspect ratio tabular grain emulsion had an average ECD of 1.54 μm, a mean thickness of 0.116 μm, and a bulk iodide level of 5.6M % iodide, based on total silver. Tabular grains accounted for more than 90 percent of the total grain projected area. The specific surface area was measured to be 565 $m^2$/mol.

Emulsion EM-4 Example Emulsion

This emulsion example is identical to EM-3, except that a silver bromide annular spacer region was precipitated between the run and dump iodide additions.

To prepare this emulsion, EM-2 was repeated, except solution K-1 was replaced with solution K-3.

The resultant silver iodobromide high aspect ratio tabular grain emulsion had a bulk iodide level of 5.3M % iodide, based on total silver. Tabular grains accounted for more than 90 percent of the total grain projected area. The specific area was measured to be 540 $m^2$/mol.

The photographic results are summarized in Table II.

TABLE II

| Emulsion | ASR % Ag | Relative CR Speed | gamma |
|---|---|---|---|
| EM-3 (comparison) | 0 | 100 | 1.35 |
| EM-4 (example) | 16 | 109 | 1.37 |

The speed increase of EM-4 over EM-3 is attributed to the presence of the annular spacer region separating the run iodide and dump iodide containing regions of the tabular grains. The higher overall iodide concentrations reduced gamma in EM-3 and EM-4 as compared to EM-1 and EM-2.

Emulsions EM-5 to EM-7 contain a higher overall level of iodide than the preceding emulsions. This is accomplished by raising the level of iodide in the run iodide addition. Dump iodide addition and the amount of silver introduced during the post-dump are similar to EM-1 and EM-2.

Emulsion EM-5 Comparative Emulsion (JDH-115)

This example was precipitated similarly to EM-1, except that the run iodide addition employed 12.0M % iodide, based on silver, during double-jet addition and the start of run iodide addition was delayed until after 13% of total silver halide been precipitated.

The following additional solutions were prepared for emulsion EM-5.

| Solution I-5 |
|---|
| 20.75M sodium bromide |
| Solution L-5 |
| 2.42M sodium bromide<br>0.33M potassium iodide |

The preparation of emulsion EM-1 was repeated through the second addition of solutions B-1 and C-1. In the next segment, solutions H-1 and I-5 were added by double jet addition utilizing accelerated flow for 21 minutes while maintaining the pAg at 9.61 and consuming 13% of the total silver used. Solution L-5 then replaced solution I-5 for the next 42 minutes over which time another 54% of the total silver was consumed. The remainder of the precipitation is identical to EM-1 starting with the pAg adjustment to 10.18 with solution J-1.

The resultant silver iodobromide high aspect ratio tabular grain emulsion had an average grain ECD of 1.27 μm and a mean grain thickness of 0.135 μm. The bulk iodide level was 9.5M % iodide, based on total silver. Tabular grains accounted for more than 90 percent of the total grain projected area. The grain volume was equal to emulsion EM-1 and the specific surface area was measured to be 485 $m^2$/mol.

Emulsion EM-6 Comparative Emulsion

This emulsion was identical to EM-5, except that the bulk (total) iodide was reduced by lowering the amount of silver halide precipitated in the run iodide addition. So that the total silver halide precipitated would remain unchanged, the double-jet addition prior to run iodide addition was expanded to precipitate an equal amount of silver halide prior to dump iodide addition. Dump iodide addition occurred immediately after run iodide addition, as in EM-5.

The preparation of emulsion EM-5 was repeated through the second addition of solutions B-1 and C-1. In the next segment, solutions H-1 and I-5 were added by double jet addition utilizing accelerated flow for 42 minutes while maintaining the pAg at 9.61 and consuming 51% of the total silver used. Solution L-5 then replaced solution I-5 for the next 23 minutes over which time another 16% of the total silver was consumed. The remainder of the precipitation is identical to EM-5 starting with the pAg adjustment to 10.18 with solution J-1.

The resultant silver iodobromide high aspect ratio tabular grain emulsion had a bulk iodide level of 4.9M % iodide, based on total silver. Tabular grains accounted for more than 90 percent of the total grain projected area. The specific surface area was 570 $m^2$/mol. Grain ECD and thickness were similar to those of EM-5.

Emulsion EM-7 Example Emulsion

This emulsion example was similar to EM-5, except that an annular spacer region was precipitated by silver and bromide ion only addition prior to the dump iodide addition. To maintain a constant bulk iodide concentration, based on total silver, silver bromide precipitation prior to run iodide addition was decreased by the amount of silver bromide precipitated in forming the annular spacer region.

The preparation of EM-5 was repeated through the second addition of solutions B-1 and C-1. In the next segment, solutions H-1 and L-5 were added by double jet addition utilizing accelerated flow for 66 minutes consuming 54% of the total silver used. Solution I-5 then replaced solution L-5 for the next 8.5 minutes over which time another 13% of the total silver was consumed. The remainder of the precipitation was identical to EM-5, starting with the pAg adjustment to 10.18 with solution J-1.

The resultant silver iodobromide high aspect ratio tabular grain emulsion had a bulk iodide level of 9.5M % iodide, based on total silver. Tabular grains accounted for more than 90 percent of the total grain projected area. The specific surface was measured to be 430 $m^2$/mol. The grain ECD and t dimensions of this emulsion were similar to those of EM-5.

The photographic results are summarized in Table III.

TABLE III

| Emulsion | ASR % Ag | Relative CR Speed | gamma |
|---|---|---|---|
| EM-5 (comparison) | 0 | 100 | 0.96 |
| EM-6 (comparison) | 0 | 94 | 1.08 |
| EM-7 (example) | 13 | 106 | 1.25 |

The data in Table III show increased speed and gamma for EM-7, which contained the annular spacer region. By referring back to Tables I and II, it is further apparent that the annular spacer region produces increasingly large speed increases as run iodide addition is increased. The varied structures of EM-5, EM-6 and EM-8 can be visually appreciated by reference to FIG. 1.

The emulsions above have shown that the invention is effective at improving the performance of high aspect ratio tabular grain emulsions. The performance of lower aspect ratio tabular grain emulsions can be similarly improved. Emulsions EM-8 and EM-9 are run-dump silver iodobromide low (<5) aspect ratio tabular grain emulsions. They are similar to the emulsions above, except that nucleation and initial growth conditions have been adjusted to yield thicker grains. EM-8 contains a 12M % iodide, based on silver, run iodide portion that is immediately followed by dump iodide addition employing potassium iodide. EM-9 differs from EM-8 by forming an annular spacer region by silver and bromide ion only addition between run iodide and dump iodide additions.

Emulsion EM-8 Comparative Emulsion

The following solutions were prepared for the precipitation of emulsion EM-8:

Solution A-8

29.4 gm bone gelatin
16.3 gm sodium bromide
4142 mL distilled water

Solution B-8

87.4 gm silver nitrate
1.9 gm bone gelatin
2.54 gm nitric acid
252 mL distilled water Solution C-8

1.76 gm bone gelatin
50.6 gm sodium bromide
236 mL distilled water

Solution D-8

240 gm bone gelatin
12.4 gm sodium bromide
7560 mL distilled water

-continued

Solution E-8

0.5M silver nitrate

Solution F-8

74.4 mL of 50/50 wt % solution of ammonium nitrate and water
74.4 mL 14.8M ammonium hydroxide Solution G-8

2.2M sodium bromide
0.3M potassium iodide

Solution H-8

2.5M silver nitrate

Solution I-8

300 mL 0.447M potassium iodide

Solution J-8

2.35M sodium bromide

To solution A-8 at 30° C. were added with vigorous stirring solutions B-8 and C-8 over a period of 2 minutes precipitating 0.4 mole of silver bromide. Solution D-8 was then added and the temperature raised to 75° C. After a 40 minute hold, the pAg was adjusted to 8.32 with solution E-8. Then solution F-8 was added and, after an additional 30 minute hold, the pH was adjusted to 7.0 and the pAg to 8.56. Solutions G-8 and H-8 were then added at a constant flow rate over a period of 15.3 minutes to consume 13.7% of the total silver precipitated. The flow rate was then raised and precipitation continued for another 24.5 minutes so that an additional 41% of total silver was consumed. Solution I-8 was then added and H-8 and J-8 were added over a period of 22 minutes while adjusting the pAg to 7.23. The emulsion was then cooled and desalted. A total of 6.7 moles of silver were used to prepare this and the subsequent emulsion.

The resulting silver iodobromide low aspect ratio tabular grain emulsion had an average grain diameter of 1.31 μm and a mean thickness of 0.277 μm. The bulk iodide level was 8.6M % iodide, based on total silver. The specific surface area was 283 $m^2$/mol.

Emulsion EM-9 Example Emulsion

This emulsion is similar to EM-8, except as noted above. The following altered solutions were prepared for emulsion EM-9:

Solution G-9

2.225M sodium bromide
0.275M potassium iodide

Solution I-9

300 mL 0.560M potassium iodide

The preparation of EM-8 was repeated through the addition of G-8 and H-8 except that solution G-9 was substituted for solution G-8. In the next step, solutions H-8 and J-8 were added by constant flow double jet addition for 6 minutes while maintaining the pAg at 8.56 and consuming 10% of the total silver used. Solution I-9 was then added and H-8 and J-8 were added over a period of 16 minutes while adjusting the pAg to 7.23. The emulsion was then cooled and desalted.

The resultant silver iodobromide low aspect ratio tabular grain emulsion had a bulk iodide level of 8.6M % iodide, based on total silver. Average grain ECD and thickness were similar to EM-8. The specific surface area was measured to be 310 $m^2$/mol.

The photographic results are summarized in Table IV.

TABLE IV

| Emulsion | ASR % Ag | Relative CR Speed | gamma |
|---|---|---|---|
| EM-8 (comparison) | 0 | 100 | 1.32 |
| EM-9 (example) | 10 | 120 | 1.25 |

The data in Table IV show a large speed advantage for emulsion EM-9 as compared to EM-8, attributable to the addition of the annular spacer region.

Example 2

The emulsions in this example show the importance of the dump iodide portion of the grain structure. The dump iodide addition produces a stimulated fluorescent emission at 575 nm when exposed to 325 nm electromagnetic radiation at 6° K. In the iodide profile shown below, N, RI, ASR and PDR were all similar in the emulsions of this example. Dump iodide addition was absent from Emulsion EM-10 and varied in the iodide source, concentration and duration in the remaining examples, EM-11 to EM-15.

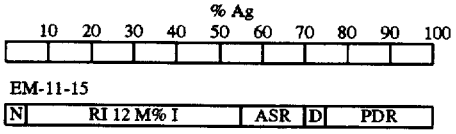

Emulsion EM-10 Comparative Emulsion

The following solutions were prepared for the precipitation of emulsion EM-10:

Solution A-10

10 gm bone gelatin
30 gm sodium bromide
1.3 mL antifoamant
4946 mL distilled water Solution B-10

0.39M silver nitrate

Solution C-10

2.0M sodium bromide

Solution D-10

350 mL 0.51M ammonium sulfate

Solution E-10

148 mL 2.5M sodium hydroxide

Solution F-10

92.5 mL 4.0M nitric acid

Solution G-10

140 gm bone gelatin
0.45 cc antifoamant
1700 mL distilled water

Solution H-10

2.75M silver nitrate

Solution I-10

2.75M sodium bromide

Solution J-10

2.4M sodium bromide

Solution L-10

-continued 2.42M sodium bromide
0.33M potassium iodide

To solution A-10 at 52° C., pH 5.9, and pAg 9.74 were added with vigorous stirring solutions B-10 and C-10 over a period of 3 minutes precipitating 0.1 moles of silver bromide. After a 1 minute hold, solution D-10 and E-10 were added sequentially. After 3 minutes, solution F-10 was added followed by solution G-10. Then solutions B-10 and C-10 were added at a constant flow rate by double-jet addition to yield a total of 0.27 mole of silver bromide. Solutions H-10 and L-10 were added by double-jet addition utilizing accelerated flow for 66 minutes while maintaining the pAg at 9.61 and consuming 52.8% of the total silver used. Solution I-10 then replaced solution L-10 for the next 8.5 minutes over which time another 13% of the total silver was consumed. The pAg was then adjusted to 10.18 with solution J-10. The emulsion was held for 2 minutes. Solutions H-10 and I-10 were then added to the element over 26 minutes while adjusting the pAg to 8.52. The emulsion was then cooled and desalted. Approximately 12 moles of silver were used to prepare this and subsequent emulsions.

The resultant silver iodobromide high aspect ratio tabular grain emulsion had an average grain ECD of 1.17 μm and thickness of 0.139 μm. The bulk iodide level was 6.5M % iodide, based on total silver. Tabular grains accounted for more than 90 percent of the total grain projected area. The specific surface area was measured at 446 $m^2$/mol. Emulsions EM-11 to EM-15 were equal in grain volume to emulsion EM-10, with slight differences in measured grain surface area.

Emulsion EM-11 Example Emulsion

Emulsion EM-11 was precipitated identically to EM-10, except that dump iodide addition also took place. Solution K-11 was prepared in addition to all of the solutions for emulsion EM-10.

Solution K-11

0.06 mol silver iodide Lippmann emulsion

The preparation of EM-10 was repeated through the pAg adjustment with solution J-10. In the next segment, solution K-11 was added and then held for 2 minutes. The remainder of the precipitation was identical to EM-10 starting with the addition of solutions H-10 and 1-10.

The resultant silver iodobromide high aspect ratio tabular grain emulsion had a bulk iodide level of 7.2M % iodide, based on total silver. Tabular grains accounted for more than 90 percent of the total grain projected area. The mean ECD and thickness of the tabular grains were similar to those of EM-10. The specific surface area was measured at 411 $m^2$/mol.

Emulsion EM-12 Example Emulsion

Emulsion EM-12 was precipitated identically to EM-11, except that more iodide was introduced during dump iodide addition. Solution K-12 was prepared in addition to all of the solutions for emulsion EM-10.

Solution K-12

0.12 mol silver iodide Lippmann emulsion

The preparation of EM-11 was repeated, except that solution K-12 was substituted for solution K-11. The remainder of the precipitation was identical to EM-11.

The resultant silver iodobromide high aspect ratio tabular grain emulsion had a bulk iodide level of 7.7M % iodide, based on total silver. Tabular grains accounted for more than 90 percent of the total grain projected area. The mean ECD and thickness of the tabular grains were similar to those of EM-10. The specific surface area was measured at 420 $m^2$/mol.

Emulsion EM-13 Example Emulsion

Emulsion EM-13 was precipitated identically to EM-11, except that more iodide was introduced during dump iodide addition. Solution K-13 was prepared in addition to all of the solutions for emulsion EM-10.

| Solution K-13 |
|---|
| 0.24 mol silver iodide Lippmann emulsion |

The preparation of EM-11 was repeated, except that solution K-13 was substituted for solution K-11. The remainder of the precipitation was identical to EM-11.

The resultant silver iodobromide high aspect ratio tabular grain emulsion had a bulk iodide level of 8.6M % iodide, based on total silver. Tabular grains accounted for more than 90 percent of the total grain projected area. The specific surface area was measured to be 403 $m^2$/mol.

Emulsion EM-14 Inventive Emulsion (JDH-227)

Emulsion EM-14 was precipitated identically to EM-11 except that a larger concentrated iodide phase (dump iodide) was added. Solution K-14 was prepared in addition to all of the solutions for emulsion EM-10.

| Solution K-14 |
|---|
| 0.36 mol silver iodide Lippmann emulsion |

The preparation of EM-11 was repeated except that solution K-14 was substituted for solution K-11. The remainder of the precipitation was identical to EM-11.

The resultant high aspect ratio tabular grain silver bromoiodide emulsion had a bulk iodide level of 9.5% iodide. Tabular grains accounted for more than 90 percent of the total grain projected area. The mean ECD and thickness of the tabular grains were similar to those of EM-10. The specific surface area was measured at 436 $m^2$/mol.

Emulsion EM-15 Example Emulsion

Emulsion EM-15 was precipitated identically to EM-14, except that the mode of dump iodide addition was changed from silver iodide Lippmann emulsion to potassium iodide. Solution K-15 was prepared in addition to all of the solutions for emulsion EM-10.

| Solution K-15 |
|---|
| 2.00 M potassium iodide |

The preparation of EM-14 was repeated, except that solution K-15 was substituted for solution K-14. Solution K-15 was run into the vessel with vigorous stirring over 5 minutes, and accounted for the same number of iodide moles as solution K-14. The remainder of the precipitation was identical to EM-14, starting with the 2 minute hold.

The resultant silver iodobromide high aspect ratio tabular grain emulsion had a bulk iodide level of 9.5M % iodide, based on total silver. Tabular grains accounted for more than 90 percent of the total grain projected area. The mean ECD and thickness of the tabular grains were similar to those of EM-10. The specific surface area was measured to be 421 $m^2$/mol.

The photographic data is summarized in Table V.

TABLE V

| Emulsion | ASR % Ag | Dump I % Ag | Dump I mode | Relative CR Speed | gamma |
|---|---|---|---|---|---|
| EM-10 (comparison) | 13 | 0.0 | none | 100 | 1.20 |
| EM-11 (example) | 13 | 0.5 | AgI | 118 | 1.25 |
| EM-12 (example) | 13 | 1.0 | AgI | 119 | 1.23 |
| EM-13 (example) | 13 | 2.0 | AgI | 121 | 1.20 |
| EM-14 (example) | 13 | 3.0 | AgI | 120 | 1.30 |
| EM-15 (example) | 13 | 3.0 | KI | 117 | 1.32 |

The data in Table V show that the dump iodide is effective to increase speed, whether added as an AgI Lippmann emulsion or added as a soluble salt. The dump iodide addition is effective throughout the concentration range of from 0.5 to 3.0 mole percent iodide, based on silver. Gamma increased somewhat as the amount of dump iodide increased; however, gamma was primarily controlled by the much larger amount of iodide added as run iodide.

Example 3

The emulsions in this example demonstrate variation in the annular spacer region satisfying the requirements of the invention. In addition, the examples also show that the location of the dump iodide region can be moved significantly relative to the total silver precipitated. The dump iodide addition produces a stimulated fluorescent emission at 575 nm when exposed to 325 nm electromagnetic radiation at 6° K.

The iodide distribution profiles of the emulsions compared in this example are shown below, with Emulsion E-14 added:

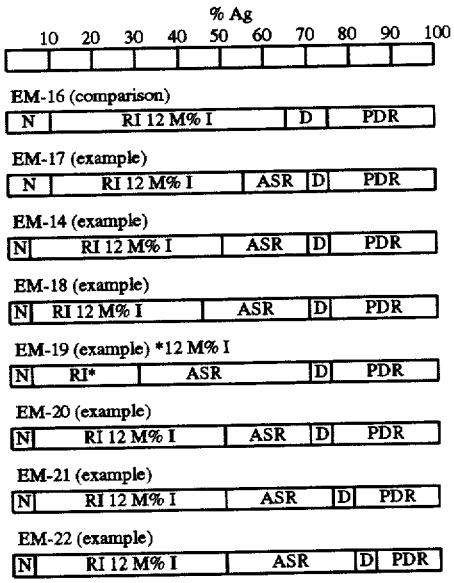

Emulsion EM-16 Comparative Emulsion

The following solutions were prepared for the precipitation of emulsion EM-16:

| |
|---|
| Solution A-16 |
| 10 gm bone gelatin |
| 30 gm sodium bromide |
| 1.3 mL antifoamant |
| 4946 mL distilled water |
| Solution B-16 |
| 0.39 M silver nitrate |
| Solution C-16 |
| 2.0 M sodium bromide |
| Solution D-16 |
| 350 mL 0.51 M ammonium sulfate |
| Solution E-16 |
| 148 mL 2.5 M sodium hydroxide |
| Solution F-16 |
| 92.5 mL 4.0 M nitric acid |
| Solution G-16 |
| 140 gm bone gelatin |
| 0.45 cc antifoamant |
| 1700 mL distilled water |
| Solution H-16 |
| 2.75 M silver nitrate |
| Solution I-16 |
| 2.75 M sodium bromide |
| Solution J-16 |
| 2.4 M sodium bromide |
| Solution K-16 |
| 0.36 mol silver iodide Lippmann emulsion |
| Solution L-16 |
| 2.42 M sodium bromide |
| 0.33 M potassium iodide |

To solution A-16 at 52° C., pH 5.9, and pAg 9.74 were added with vigorous stirring solutions B-16 and C-16 over a period of 3 minutes precipitating 0.1 moles of silver bromide. After a 1 minute hold, solution D-16 and E-16 were added sequentially. After 3 minutes, solution F-16 was added followed by solution G-16. Then solutions B-16 and C-16 were added at a constant flowrate by double jet addition to yield a total of 0.27 mole of silver bromide. Solutions H-16 and I-16 were added by double jet addition utilizing accelerated flow for 21 minutes while maintaining the pAg at 9.61 and consuming 15.3% of the total silver used. Solution L-16 then replaced solution I-16 for the next 42 minutes over which time another 52.6% of the total silver was consumed. The pAg was then adjusted to 10.18 with solution J-16. Solution K-16 was added and held for 2 minutes. Solutions H-16 and I-16 were then added to the element over 26 minutes while adjusting the pAg to 8.52. The emulsion was then cooled and desalted. Approximately 12 moles of silver were used to prepare this and subsequent emulsions.

The resultant high aspect ratio tabular grain silver bromoiodide emulsion had an average grain ECD of 1.21 μm and a mean thickness of 0.129 μm. The bulk iodide level was 9.5M % iodide, based on total silver. Tabular grains accounted for more than 90 percent of the total grain projected area. The specific surface area was measured at 491 $m^2$/mol.

Emulsion EM-17 Example Emulsion

The preparation of EM-16 was repeated through the addition of the second addition of solutions B-16 and C-16. Solutions H-16 and I-16 were added by double jet addition utilizing accelerated flow for 15 minutes while maintaining the pAg at 9.61 and consuming 10.2% of the total silver used. Solution L-16 then replaced solution I-16 for the next 47 minutes over which another 52.6% of the total silver was consumed. Solution I-16 was re-substituted for solution L-16 using accelerated flow for 6 minutes precipitating an additional 5% of the silver. The remainder of the precipitation was identical to emulsion EM-16 starting with the pAg adjustment to 10.18 with solution J-16.

The resultant silver iodobromide high aspect ratio tabular grain emulsion had a bulk iodide level of 9.5M % iodide, based on total silver. The thickness and ECD of the tabular grains were similar to those of EM-16. Tabular grains accounted for more than 90 percent of the total grain projected area. The specific surface area was measured to be 446 $m^2$/mol.

Emulsion EM-18 Example Emulsion

The preparation of EM-16 was repeated through the addition of the second addition of solutions B-16 and C-16. Solutions H-16 and L-16 were added by double jet addition utilizing accelerated flow for 49 minutes while maintaining the pAg at 9.61 and consuming 32.8% of the total silver used. Solution I-16 then replaced solution L-16 for the next 24 minutes over which another 33% of the total silver was consumed. The remainder of the precipitation was identical to emulsion EM-16 starting with the pAg adjustment to 10.18 with solution J-16.

The resultant silver iodobromide high aspect ratio tabular grain emulsion had a bulk iodide level of 7.0M % iodide, based on total silver. The thickness and ECD of the grains were similar to those EM-16. Tabular grains accounted for more than 90 percent of the total grain projected area. The specific surface area was measured to be 446 $m^2$/mol.

Emulsion EM-19 Example Emulsion

The preparation of EM-16 was repeated through the addition of the second addition of solutions B-16 and C-16. Solutions H-16 and L-16 were added by double jet addition utilizing accelerated flow for 28 minutes while maintaining the pAg at 9.61 and consuming 12.8% of the total silver used. Solution I-16 then replaced solution L-16 for the next 42 minutes over which another 53% of the total silver was consumed. The remainder of the precipitation was identical to emulsion EM-16 starting with the pAg adjustment to 10.18 with solution J-16.

The resultant silver iodobromide high aspect ratio tabular grain emulsion had a bulk iodide level of 4.5M % iodide, based on total silver. The thickness and ECD of the grains were similar to those EM-16. Tabular grains accounted for more than 90 percent of the total grain projected area. The specific surface area was measured to be 472 $m^2$/mol.

Emulsion EM-20 Example Emulsion

Emulsion EM-20 was prepared identically to emulsion EM-14 except that solution K-20 was substituted for solution K-14.

| |
|---|
| Solution K-20 |
| 0.24 mol silver iodide Lippmann emulsion |

The resultant high aspect ratio tabular grain silver bromoiodide emulsion had a bulk iodide level of 8.6% iodide. The thickness and ECD of the grains were similar to those EM-16. Tabular grains accounted for more than 90 percent of the total grain projected area. The specific surface area was measured at 411 $m^2$/mol.

Emulsion EM-21 Example Emulsion

The preparation of EM-14 was repeated through the addition of solutions H-10 and L-10. Solutions H-10 and I-10 were then added by double jet addition utilizing accelerated flow for 14 minutes while maintaining the pAg at 9.61 and consuming 22% of the total silver used. The pAg was then adjusted to 10.18 with solution J-10. Solution K-20 was added and held for 2 minutes. Solutions H-10 and 1-10 were then added to the element over 18 minutes while adjusting the pAg to 8.52. The emulsion was then cooled and desalted. Approximately 12 moles of silver were used to prepare this emulsion.

The resultant silver iodobromide high aspect ratio tabular grain emulsion had a bulk iodide level of 8.6M % iodide, based on total silver. The thickness and ECD of the grains were similar to those EM-16. Tabular grains accounted for more than 90 percent of the total grain projected area. The specific surface area was measured to be 426 $m^2$/mol.

Emulsion EM-22 Example Emulsion

The preparation of EM-14 was repeated through the addition of solutions H-10 and L-10. Solutions H-10 and I-10 were then added by double jet addition utilizing accelerated flow for 18 minutes while maintaining the pAg at 9.61 and consuming 32% of the total silver used. The pAg was then adjusted to 10.18 with solution J-10. Solution K-20 was added and held for 2 minutes. Solutions H-10 and I-10 were then added to the element over 9 minutes while adjusting the pAg to 8.52. The emulsion was then cooled and desalted. Approximately 12 moles of silver were used to prepare this emulsion.

The resultant silver iodobromide high aspect ratio tabular grain emulsion had a bulk iodide level of 8.6M % iodide, based on total silver. The thickness and ECD of the grains were similar to those EM-16. Tabular grains accounted for more than 90 percent of the total grain projected area. The specific surface area was measured to be 461 $m^2$/mol.

The photographic data is summarized in Table VI.

TABLE VI

| Emulsion | ASR % Ag | Dump I % Ag | Relative CR Speed | gamma |
|---|---|---|---|---|
| EM-16 (comparison) | 0.0 | 3.0 | 100 | 1.30 |
| EM-17 (example) | 5.0 | 3.0 | 112 | 1.25 |
| EM-14 (example) | 13.0 | 3.0 | 114 | 1.30 |
| EM-18 (example) | 33.0 | 3.0 | 110 | 1.70 |
| EM-19 (example) | 53.0 | 3.0 | 115 | 1.98 |
| EM-20 (example) | 13.0 | 2.0 | 115 | 1.30 |
| EM-21 (example) | 22.0 | 2.0 | 108 | 1.33 |
| EM-22 (example) | 32.0 | 2.0 | 111 | 1.25 |

The data in Table VI demonstrate that the annular spacer region is effective to increase speed over the entire observed range of from 5% to 53% of the total silver. In addition, emulsions EM-20 to EM-22 show the position of the annular spacer region and dump iodide regions can be moved with respect to the total precipitated silver without losing the speed advantage. Emulsions EM-16 to EM-19 also show that increasing the percentage of silver provided by the annular spacer region (and therefore decreasing the percentage of silver containing run iodide) led to increasing gamma levels. From EM-19 it is apparent that disadvantageously levels of gamma for many photographic applications would be in evidence in the absence of run iodide incorporation.

Example 4

The emulsions in this example demonstrate contributions of run iodide incorporation in run-dump grains when local run iodide concentrations range from 12M % I to 32M % I.

From a comparison of the emulsions it is demonstrated that emulsion speed increases as an Iodide Distribution Factor (IDF) decreases. The IDF is calculated as the average local run iodide concentration in mole percent (M % I) minus the percentage of total silver precipitated prior to initiating run iodide addition (% Ag)—that is, the amount of silver in region N shown below.

The iodide distribution profiles of the emulsions compared in this example are shown below:

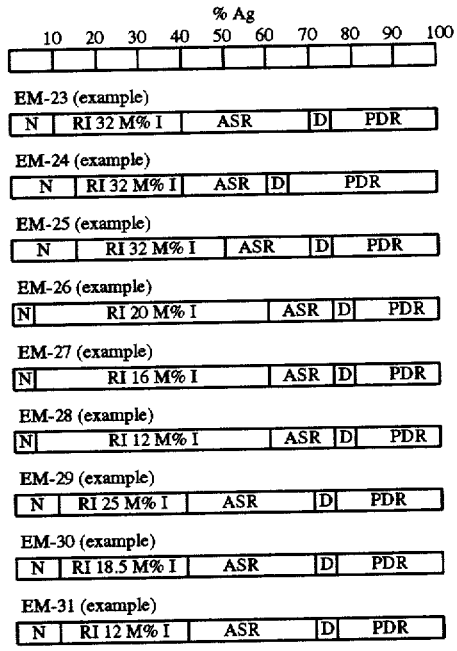

Emulsion EM-23 Example Emulsion

The following solutions were prepared for the precipitation of emulsion EM-23:

Solution A-23

10 gm bone gelatin
30 gm sodium bromide
1.3 mL antifoamant
4946 mL distilled water Solution B-23

0.39 M silver nitrate

Solution C-23

2.0 M sodium bromide

Solution D-23

350 mL 0.51 M ammonium sulfate

Solution E-23

148 mL 2.5 M sodium hydroxide

Solution F-23

92.5 mL 4.0 M nitric acid

Solution G-23

140 gm bone gelatin
0.45 cc antifoamant
1700 mL distilled water

Solution H-23

2.75 M silver nitrate

Solution I-23

2.75 M sodium bromide

Solution J-23

-continued 2.4 M sodium bromide
Solution K-23

0.18 mol silver iodide Lippmann emulsion
Solution L-23

1.87 M sodium bromide
0.88 M potassium iodide
Solution M-23

1.20 M silver nitrate

To solution A-23 at 52° C., pH 5.9, and pAg 9.74 were added with vigorous stirring solutions B-23 and C-23 over a period of 3 minutes precipitating 0.1 moles of silver bromide. After a 1 minute hold, solution D-23 and E-23 were added sequentially. After 3 minutes, solution F-23 was added followed by solution G-23. Solutions M-23 and C-23 were added by double jet addition utilizing accelerated flow over 17 minutes to consume 5.8% of the total silver. Then solutions H-23 and L-23 were added by double jet addition utilizing accelerated flow for 47 minutes while maintaining the pAg at 9.61 and consuming 24% of the total silver used. Solution 1-23 then replaced solution L-23 for the next 25 minutes over which time another 31.8% of the total silver was consumed. The pAg was then adjusted to 10.18 with solution J-23. Solution K-23 was added and held for 2 minutes. Solutions H-23 and I-23 were then added to the element over 33 minutes while adjusting the pAg to 8.52. The emulsion was then cooled and desalted. Approximately 12 moles of silver were used to prepare this and subsequent emulsions.

The resultant silver iodobromide low aspect ratio tabular grain emulsion had an average grain ECD of 0.57 μm and a mean thickness of 0.263 μm. The bulk iodide level was 9.1M % iodide, based on total silver. Tabular grains accounted for more than 90 percent of the total grain projected area. The specific surface area was measured at 340 $m^2$/mol. Emulsions EM-24 and EM-25 were equal in grain volume to emulsion EM-23, with slight differences in surface area (which were measured).

Emulsion EM-24 Example Emulsion

The preparation of emulsion EM-23 was repeated through to the addition of solution G-23. Solutions M-23 and C-23 were added by double jet addition utilizing accelerated flow over 36 minutes to consume 15.7% of the total silver. Then solutions H-23 and L-23 were added by double jet addition utilizing accelerated flow for 47 minutes while maintaining the pAg at 9.61 and consuming 24% of the total silver used. Solution I-23 then replaced solution L-23 for the next 19 minutes over which time another 22% of the total silver was consumed. The pAg was then adjusted to 10.18 with solution J-23. Solution K-23 was added and held for 2 minutes. Solutions H-23 and I-23 were then added to the element over 33 minutes while adjusting the pAg to 8.52. The emulsion was then cooled and desalted.

The resultant silver iodobromide tabular grain silver bromoiodide emulsion had a bulk iodide level of 9.0M % iodide, based on total silver. Grain ECD and thickness levels were similar to EM-23. Tabular grains accounted for more than 90 percent of the total grain projected area. The specific surface area was measured at 375 $m^2$/mol.

Emulsion EM-25 Example Emulsion

The preparation of emulsion EM-23 was repeated through to the addition of solution G-23. Solutions M-23 and C-23 were added by double jet addition utilizing accelerated flow over 50 minutes to consume 25.7% of the total silver. Then solutions H-23 and L-23 were added by double jet addition utilizing accelerated flow for 47 minutes while maintaining the pAg at 9.61 and consuming 23.9% of the total silver used. Solution I-23 then replaced solution L-23 for the next 12 minutes over which time another 12.1% of the total silver was consumed. The pAg was then adjusted to 10.18 with solution J-23. Solution K-23 was added and held for 2 minutes. Solutions H-23 and I-23 were then added to the element over 33 minutes while adjusting the pAg to 8.52. The emulsion was then cooled and desalted.

The resultant silver iodobromide tabular grain emulsion had a bulk iodide level of 8.9M % iodide, based on total silver. Grain ECD and thickness were similar to EM-23. Tabular grains accounted for more than 90 percent of the total grain projected area. The specific surface area was measured at 395 $m^2$/mol.

The photographic results are given in Table VII.

TABLE VII

| Emulsion | Run I local % I | N % Ag | IDF | Relative CR Speed | gamma |
|---|---|---|---|---|---|
| EM-23 | 32.0 | 5.8 | 26.2 | 100 | 1.81 |
| EM-24 | 32.0 | 15.7 | 16.3 | 107 | 1.68 |
| EM-25 | 32.0 | 25.7 | 6.3 | 115 | 1.55 |

The data presented in Table VII clearly show that the photographic speed increases as the Iodide Distribution Factor (IDF) is lowered. In this series of examples IDF is lowered simply by delaying run iodide addition.

Emulsion EM-26 Example Emulsion

The solutions utilized for EM-26 were identical to those for emulsion EM-23, except that solution L-26 was substituted for solution L-23 and solution K-26 was added.

Solution L-26

2.20 M sodium bromide
0.55 M potassium iodide
Solution K-26

0.36 mol silver iodide Lippmann emulsion

To solution A-23 at 52° C., pH 5.9, and pAg 9.74 were added with vigorous stirring solutions B-23 and C-23 over a period of 3 minutes precipitating 0.1 moles of silver bromide. After a 1 minute hold, solution D-23 and E-23 were added sequentially. After 3 minutes, solution F-23 was added followed by solution G-23. Then solutions B-23 and C-23 were added at a constant flowrate by double jet addition to yield a total of 0.27 mole of silver bromide. Solutions H-23 and L-23 were added by double jet addition utilizing accelerated flow for 66 minutes while maintaining the pAg at 9.61 and consuming 52.8% of the total silver used. Solution I-23 then replaced solution L-23 for the next 8.5 minutes over which time another 13% of the total silver was consumed. The pAg was then adjusted to 10.18 with solution J-23. Solution K-26 was added and held for 2 minutes. Solutions H-23 and I-23 were then added to the element over 26 minutes while adjusting the pAg to 8.52. The emulsion was then cooled and desalted. Approximately 12 moles of silver were used to prepare this emulsion and emulsions EM-27 and EM-28.

The resultant silver iodobromide low aspect ratio tabular grain emulsion had an average grain diameter of 0.51 μm and a mean thickness of 0.279 μm. The bulk iodide level was 13.8M % iodide, based on total silver. Tabular grains accounted for more than 90 percent of the total grain projected area. The specific surface area was measured to be 355 $m^2$/mol. Emulsions EM-27 and EM-28 were of equal grain volume to EM-26.

Emulsion EM-27 Example Emulsion

The solutions utilized for EM-27 were identical to those for emulsion EM-26 except that solution L-27 was used.

| Solution L-27 |
|---|
| 2.31 M sodium bromide |
| 0.44 M potassium iodide |

The preparation of emulsion EM-27 was identical to emulsion EM-26, except that solution L-27 replaced solution L-26. The resultant tabular grain silver bromoiodide emulsion had a bulk iodide level of 11.7M % iodide, based on total silver. Grain ECD and thickness was similar to EM-26. Tabular grains accounted for more than 90 percent of the total grain projected area. The specific surface area was measured to be 367 $m^2$/mol.

Emulsion EM-28 Example Emulsion

The solutions utilized for EM-28 were identical to those for emulsion EM-26, except that solution L-28 was used.

| Solution L-28 |
|---|
| 2.42 M sodium bromide |
| 0.33 M potassium iodide |

The preparation of emulsion EM-28 was identical to emulsion EM-26, except that solution L-28 replaced solution L-26.

The resultant silver iodobromide tabular grain emulsion had a bulk iodide level of 9.5M % iodide, based on total silver. Grain ECD and thickness was similar to EM-26. Tabular grains accounted for more than 90 percent of the total grain projected area. The specific surface area was measured to be 436 $m^2$/mol.

The photographic results are given in Table VIII.

TABLE VIII

| Emulsion | Run I local % I | N % Ag | IDF | Relative CR Speed | gamma |
|---|---|---|---|---|---|
| EM-26 | 20.0 | 2.2 | 17.8 | 100 | 1.22 |
| EM-27 | 16.0 | 2.2 | 13.8 | 109 | 1.29 |
| EM-28 | 12.0 | 2.2 | 9.8 | 137 | 1.30 |

The data in Table VIII show that there is a large speed increase when the IDF dropped below 12. Even though the run iodide concentrations dropped in reaching the higher speeds, very little increase in gamma was observed. This is a surprising and highly useful discovery. In this series IDF was reduced entirely by lower the local concentration of run iodide.

Emulsion EM-29 Example Emulsion

The solutions utilized for EM-29 were the same as those for emulsion EM-23, except that solution L-29 was used.

| Solution L-29 |
|---|
| 2.06 M sodium bromide |
| 0.69 M potassium iodide |

The preparation of emulsion EM-29 was identical to emulsion EM-23, except that solution L-29 replaced solution L-23.

The resultant silver iodobromide low aspect ratio tabular grain emulsion had a mean grain ECD of 0.60 μm and a mean thickness of 0.252 μm. The bulk iodide level was 7.5M % iodide, based on total silver. Tabular grains accounted for more than 90 percent of the total grain projected area. The specific surface area was measured to be 335 $m^2$/mol. The mean grain volume for emulsions EM-30 and EM-31 which follow were the same as EM-29.

Emulsion EM-30 Example Emulsion

The solutions utilized for EM-30 were the same as those for emulsion EM-23, except that solution L-30 was used.

| Solution L-30 |
|---|
| 2.24 M sodium bromide |
| 0.51 M potassium iodide |

The preparation of emulsion EM-30 was identical to emulsion EM-23, except that solution L-30 replaced solution L-23.

The resultant silver iodobromide tabular grain emulsion had a bulk iodide level of 6.0M % iodide, based on total silver. Grain ECD and thickness were similar to EM-29. Tabular grains accounted for more than 90 percent of the total grain projected area. The specific surface area was measured to be 345 $m^2$/mol.

Emulsion EM-31 Example Emulsion

The solutions utilized for EM-31 were the same as those for emulsion EM-23, except that solutions K-31 and L-31 were used.

| Solution K-31 |
|---|
| 0.36 mol silver iodide Lippmann emulsion |
| Solution L-31 |
| 2.42 M sodium bromide |
| 0.33 M potassium iodide |

The preparation of emulsion EM-23 was followed up to the point where solution G-23 was added. Then solutions B-23 and C-23 were added at a constant flowrate by double jet addition to yield a total of 0.27 mole of silver bromide. Solutions H-23 and L-23 were added by double jet addition utilizing accelerated flow for 49 minutes while maintaining the pAg at 9.61 and consuming 32.8% of the total silver used. Solution I-23 then replaced solution L-23 for the next 24 minutes over which time another 33% of the total silver was consumed. The pAg was then adjusted to 10.18 with solution J-23. Solution K-31 was added and held for 2 minutes. Solutions H-23 and I-23 were then added to the element over 26 minutes while adjusting the pAg to 8.52.

The resultant silver iodobromide tabular grain emulsion had a bulk iodide level of 7.0M % iodide, based on total silver. Grain ECD and thickness were similar to EM-29. Tabular grains accounted for more than 90 percent of the total grain projected area. The specific surface area was measured to be 446 $m^2$/mol.

The photographic results are given in Table IX.

TABLE IX

| Emulsion | Run I local % I | N % Ag | IDF | Relative CR Speed | gamma |
|---|---|---|---|---|---|
| EM-29 | 25.0 | 5.8 | 19.2 | 100 | 1.74 |
| EM-30 | 18.5 | 5.8 | 12.7 | 99 | 1.81 |
| EM-31 | 12.0 | 2.2 | 9.8 | 117 | 1.70 |

The data in Table IX confirms the observation in Table VIII that there is a large speed increase when the is IDF below 12. In EM-31 the amount of dump iodide was increased to offset the reduction in bulk iodide incorporated as run iodide. The very useful result was achieved of obtaining a large speed increase while actually lowering gamma.

The invention has been described in detail with particular reference to preferred embodiments thereof, but it will be understood that variations and modifications can be effected within the spirit and scope of the invention.

What is claimed is:

1. A radiation-sensitive emulsion comprised of a dispersing medium and silver halide grains including tabular grains
   accounting for greater than 50 percent of total grain projected area,
   having {111} major faces, and
   containing greater than 50 mole percent bromide and at least 0.5 mole percent iodide, based on total silver,
   wherein said tabular grains include tabular grains having a controlled, non-uniform iodide distribution providing, when the emulsion is exposed to 325 nm electromagnetic radiation at 6° K., a stimulated fluorescent emission at 575 nm that is at least 5 percent of the maximum intensity of concurrently stimulated fluorescent emission in the wavelength range of from 490 to 560 nm, said controlled, non-uniform iodide distribution tabular grains being comprised of
   a central region accounting for from 5 to 85 percent of total silver and containing an iodide concentration of at least 0.5 mole percent, based on silver,
   an annular spacer region extending laterally outward from the central region, accounting for at least 2 percent of total silver, and containing an iodide concentration that is less than half the iodide concentration of the central region, and
   a peripheral region comprised of a zone extending outwardly from and having a higher iodide concentration than the annular spacer region, iodide within the zone providing the stimulated fluorescent emission at 575 nm.

2. A radiation-sensitive emulsion according to claim 1 wherein the central region has an average iodide concentration of at least 1.0 mole percent iodide, based on silver.

3. A radiation-sensitive emulsion according to claim 1 wherein the central region has an average iodide concentration of less than 20 mole percent iodide, based on silver.

4. A radiation-sensitive emulsion according to claim 1 wherein less than 40 percent of the central region is formed prior to iodide addition.

5. A radiation-sensitive emulsion according to claim 4 wherein less than 10 percent of the central region is formed prior to iodide addition.

6. A radiation-sensitive emulsion according to claim 1 wherein the annular spacer region accounts for up to 85 percent of total silver.

7. A radiation-sensitive emulsion according to claim 6 wherein the annular spacer region accounts for 4 to 50 percent of total silver.

8. A radiation-sensitive emulsion according to claim 1 wherein the annular spacer region is formed by silver bromide precipitation.

9. A radiation-sensitive emulsion according to claim 1 wherein the stimulated fluorescent emission at 575 nm is at least one third the maximum intensity of concurrently stimulated fluorescent emission in the wavelength range of from 490 to 560 nm.

10. A radiation-sensitive emulsion according to claim 1 wherein up 5 mole percent iodide, based on total silver, is contained in the peripheral region zone.

11. A radiation-sensitive emulsion according to claim 10 wherein from 1 to 3 mole percent iodide, based on total silver, is contained in the peripheral region zone.

12. A radiation-sensitive emulsion according to claim 1 wherein the tabular grains having a controlled, non-uniform iodide distribution contain from 10 to 50 percent of total silver in a second zone precipitated after the peripheral region zone.

13. A radiation-sensitive emulsion according to claim 12 wherein the second zone is formed by silver ion addition without iodide ion addition.

14. A radiation-sensitive emulsion according to claim 12 wherein the second zone contains less than 35 percent of total silver and forms a shell.

15. A radiation-sensitive emulsion according to claim 1 wherein the central region is comprised of a centrally located portion formed without iodide addition and an iodide containing portion having an average iodide concentration of from 12 to 32 mole percent iodide, based on silver, and, when the percent silver forming the centrally located portion of the central region is subtracted from the iodide concentration of the iodide containing portion, the difference is less than 12.

16. A radiation-sensitive emulsion according to claim 15 wherein the difference is less than 10.

* * * * *